US010974542B1

(12) United States Patent
Schulman et al.

(10) Patent No.: US 10,974,542 B1
(45) Date of Patent: Apr. 13, 2021

(54) GLITTER FRAMED POSTER BOARD

(71) Applicant: Royal Consumer Products LLC, Norwalk, CT (US)

(72) Inventors: Steven A. Schulman, Greenwich, CT (US); Irina Luca-Baciu, Norwalk, CT (US)

(73) Assignee: Royal Consumer Products LLC, Norwalk, CT (US)

( * ) Notice: Subject to any disclaimer, the term of this patent is extended or adjusted under 35 U.S.C. 154(b) by 0 days.

(21) Appl. No.: 17/089,704

(22) Filed: Nov. 4, 2020

(51) Int. Cl.
*B44C 1/10* (2006.01)
*G09F 15/00* (2006.01)
*G09F 15/02* (2006.01)

(52) U.S. Cl.
CPC ..... *B44C 1/105* (2013.01); *G09F 15/0012* (2013.01); *G09F 15/02* (2013.01)

(58) Field of Classification Search
CPC ..... B44C 1/105; G09F 15/0012; G09F 15/02; A47G 1/0616; A47G 1/0627; A47G 1/0633
See application file for complete search history.

(56) References Cited

U.S. PATENT DOCUMENTS 3,886,677 A * 6/1975 Behring ..... A47G 1/0633 40/736
4,231,833 A * 11/1980 Lieberman ..... A47G 1/0633 156/249
4,769,265 A * 9/1988 Coburn, Jr. ..... B44C 1/105 428/323
6,354,030 B1 * 3/2002 Harris ..... A47G 1/0627 248/467
6,962,017 B1 * 11/2005 Pounds ..... G09F 1/12 40/781
2004/0144481 A1 * 7/2004 Poulos ..... B44C 1/10 156/230
2005/0183307 A1 * 8/2005 Parker ..... A47G 1/0633 40/780
2009/0094874 A1 * 4/2009 Smith ..... G09F 3/10 40/760
2020/0082743 A1 * 3/2020 Schulman ..... A47G 1/0627

* cited by examiner

*Primary Examiner* — Gary C Hoge
(74) *Attorney, Agent, or Firm* — Robert J. Hess; Hess Patent Law Firm

(57) ABSTRACT

A glitter framed poster board having relatively large size glitter chips. A rectangular frame is laminated onto peripheral regions of a poster board. The rectangular frame includes four strips of paper arranged to form the frame. Each strip is coated on one side to adhere thereto the large size glitter chips that fully cover the strips. Each of the strips preferably has ends shaped into triangular patterns. A pair of diagonals from adjacent triangular patterns are in respective corners of the rectangular frame.

5 Claims, 5 Drawing Sheets
(4 of 5 Drawing Sheet(s) Filed in Color)

GLITTER FRAMED POSTER BOARD

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable

BACKGROUND OF THE INVENTION

(1) Field of the Invention

The invention pertains to glitter framed poster boards for which the poster boards appear to have a frame in their peripheral regions that is covered by glitter.

(2) Description of Related Art Including Information Disclosed Under 37 CFR 1.97 and 1.98

Poster boards are relatively lightweight and made of thick, fairly stiff cardboard composed of layers of paper or paper pulp compressed together and typically used to support displays. The cardboard may be either paperboard, corrugated fiberboard and/or cardstock.

Currently, poster boards having a dimension of 22"×28" that have glitter frame are made by using a traditional application, namely, a silk screen application, by which glitter chips fall randomly onto the board mixed with adhesive and apply the glitter chips onto frame of the board. For very fine glitter chips, such as 2/125" or smaller, the use of this silk screen application results in production of a glitter framed poster board having some shedding of the glitter chips, but tolerable from a commercial standpoint as the quantity of shedding is sufficiently low that it will not cause a mess at retail stores. However, for large glitter chips (so-called medium chips or perhaps "Big chips" of 1/24"), the use of the silk screen application results in the production of a glitter framed poster board having much more shedding of the glitter chips than is the case for much smaller glitter chips would cause a mess at retail stores. Such a mess might well bring untoward attention to the mess by the purchasing public. Further, the chips are too big to be applied 100% onto the frame of the board without damaging the white center of the poster board should heat and pressure be applied.

The following table provides conventional glitter chip sizes as set forth from an online article at polishandpigments.blogspot.com/2010/10/glitter-size-explanation.html.

| Glitter Size | Inches | Fractional | Microns | Millimeters |
|---|---|---|---|---|
| Extra Large | .250" | 1/4" | 6250 | 6.25 |
| Large | .125" | 1/8" | 3125 | 3.125 |
| | .1" | 1/10" | 2540 | 2.540 |
| Medium | .094" | 47/500" | 2385 | 2.385 |
| | .083" | 1/12" | 2108 | 2.108 |
| | .078" | 39/500" | 2000 | 2 |
| | .063" | 1/16" | 1600 | 1.600 |
| | .062" | 31/500" | 1550 | 1.55 |
| | .042" | 1/24" | 1067 | 1.067 |
| Fine | .040" | 1/25" | 1000 | 1 |
| | .035" | 7/200" | 875 | 0.875 |
| | .031" | 1/32" | 787 | 0.787 |
| Very Fine | .025" | 1/40" | 625 | 0.625 |
| | .016" | 2/125" | 400 | 0.4 |
| Extra Fine | .015" | 3/200" | 375 | 0.375 |
| | .012" | 3/250" | 300 | 0.3 |
| | .01" | 1/96" | 254 | 0.254 |
| Ultra Fine | .008" | 1/125" | 200 | 0.2 |
| Micro Fine | .004" | 1/250" | 100 | 0.1 |
| | .003" | 3/1000" | 75 | 0.075 |
| | .002-.003" | 1/250"+ | 65-82 | 0.065-0.082 |
| Ultra Micro Fine | .002" | 1/500" | 50 | 0.05 |
| SpectraFlair 1500-35 (course) | .001" | 1/1000" | 35 | 0.035 |
| SpectraFlair 1500-20 (standard) | <.001" | <1/1000" | 20 | 0.02 |
| SpectraFlair 1500-14 (fine) | <.001" | <1/1000" | 14 | 0.014 |

The present inventor recognized that there is a desire to apply larger glitter chips to form peripheral frames for poster boards and thereby yield a more sparkly effect of the glitter chips than can be achieved from smaller glitter chips. Nevertheless, the present inventor had concerns about the use of the traditional silk screen application for larger particle size glitter, because of tendency for such larger glitter chips to shed significantly more than is the case for smaller glitter chips that are glued to form a frame for a poster board. This is due in part because not of the glue underneath the larger glitter chips cover the full underside surface of the larger glitter chips.

Indeed, the glitter chips at the edge of the poser board overlap the board and thus lack glue underneath and they will have to be cut to avoid extending past the edge. This leaves glitter chips at the edge of the poster board that are not rounded but edged and are more ready to fall off since they have been disturbed from their glue bed. Those which fall immediately from the cutting need to be replaced by hand, which is expensive. Those that do not fall immediately, but when used, are more apt to hurt someone, because they are sharp. In any case, glitter chips from other parts of the board also shed and this would create a mess. Although glitter chips that are both 1/125 and 1/24" are commonly used without hazard warnings, the product still would cause a mess at retail stores and wherever used.

In an effort to devise a technique that eliminated the problems associated with excessive shedding of the larger size glitter chips, the present inventor went through about 5 or 6 trials to find a better way. Eventually, the present inventor produced samples of 1/24" 'Big Chip" glitter that did not shed but covered a non-paper square web about 7"×8" (it seemed like a rubberized latex paper or laminated multi layered web on which the 1/24" glitter lay). With those samples, a suppler was able to reproduce the process and then cut from the resulting web strips to affix to the poster board to provide a frame with larger size glitter chips whose chips did not shed as much as was the case when the traditional silk screen application was used with the larger size glitter chips to provide the frame. Indeed, the amount of shedding of the larger size glitter chips by using the technique devised by the inventor approximated the amount of shedding of smaller size glitter chips using the traditional silk screen application and was therefore much less than when the larger size glitter chips used the traditional silk screen application.

Nevertheless, one could see that the glitter chips were affixed by lamination of a web onto the board, because the strips showed their ends where the other strip from the adjacent side continued. One of the present inventors suggested that, rather than cutting the strips square at their end, cut them at a 45 degrees angle to hide the intersection of the strips. This product thus was completed by September 2020. That is, about 18 months from its start and about 8 months to correct t5e shedding issue.

A full sheet no shedding glitter paper/tape has been available on the market for years. For instance, a glitter film role under the trade name d-c-Fix® Glittery Pink was cut and its backing paper peeled off to reveal a sticky surface that was adhered to a picture frame. The steps involved are described online at dcfixbrand.com/glittery-picture-frame-diy/.

According to the online site LEARTS at kastyles.co/4-ways-to-protect-glitter-from-shedding-on-craft-projects/, there are four ways to protect glitter from shedding. The four ways involve applying to the glitter any of the following: clear gloss spray paint, clear gloss spray lacquer, gloss modge podge, and clear nail polish. According to the online site favecrafts at favecrafts.com/Techniques/How-to-Seal-Glitter, glitter on paper can be sealed against shedding by using a spray sealer or a decoupage medium.

The invention concerns the use of glitter 1/24" as opposed to glitter 2/125" on a posterboard. There was no problem with 2/125" glitter sticking to the posterboard. The issue is with 1/24" glitter, which the present invention was used for to produce a resulting glitter that yields a much more reflective and refractive poster board product.

SUMMARY OF THE INVENTION

In accordance with the present invention, the inventive method is to first make a full sheet (22"×28") of glitter paper by securely applying appropriately sized glitter chips to paper without shedding, such as to coated one side (C1S) paper, via a conventional ceramic coating machine. The paper with the glitter chips is then cut into strips of a desired dimension for the frame and their ends are cut to form triangular patterns so that each strip connects almost seamlessly with adjacent strips. The strips are then laminated onto a conventional poster board—a conventional hot stamping process under high pressure may be used to effectuate this. The end result is a posterboard having a glitter frame on its surface and the whole posterboard looks about identical as the one made by the traditional method, except that the glitter appears more sparkly.

The present invention involves a method of assembly whose steps are:

(1) coating glue on C1S paper (e.g., a full sheet 22"×28") with a coating machine, (2) depositing glitter chips to the coating of glue on the c1s side of the paper by pressing the chips into the glue while simultaneously heating such as with a hot stamping press, (3) vacuuming away any excess of the glitter chips deposited, (4) cutting the 1CS paper into strips (ends are cut into triangle patterns), and (5) laminating the strips to the poster board after applying glue to the uncoated side of the 1CS paper of the strips and arranging the strips so that diagonals of triangle patterns at the ends of adjacent strips abut each other. By so doing, each strip seems to almost connect seamlessly with adjoining strips.

The method of assembly in accordance with the invention solves the excessive shedding problem that otherwise arises for large glitter chips that are deposited upon a poster board via the silk screen application. The assembly method of the invention uses C1S paper so that the glitter strips optically appear to be on top of the poster board. There is little glitter chip shedding during transit or when the boards were rubbed. The way the paper is applied with triangular shapes at their corners of the frame renders it less evident that the glitter was applied using paper or tape, probably due to the change in direction at the diagonal from the horizontal edge of the frame that the eye has a tendency to follow when looking at the frame.

The conventional silk screen application deposited the glitter onto a bed of glue on the poster board in the border area. For larger size glitter, some would partially extend past the edge of the poster board and thus would need to be cut and smoothed. However, the glitter chips could not be pressed and heated into the board, because the white area in the center of the poster board could not be damaged, which would be commercially unacceptable. In contrast, the way of the present invention is that the glitter is deposited onto a bed of glue that is over the full sheet of C1S paper and the glitter is then pressed down and heated so it securely attaches the sheet. The full sheet is cut into strips, which are laminated onto a poster board by arranging the strips relative to each other to form a rectangular frame.

BRIEF DESCRIPTION OF THE SEVERAL VIEWS OF THE DRAWING(S)

For a better understanding of the present invention, reference is made to the following description and accompanying drawings, while the scope of the invention is set forth in the appended claims. The patent or application file contains at least one drawing executed in color. Copies of this patent with color drawings will be provided by the Office upon request and payment of the necessary fee.

DETAILED DESCRIPTION OF THE INVENTION

Figure 1:
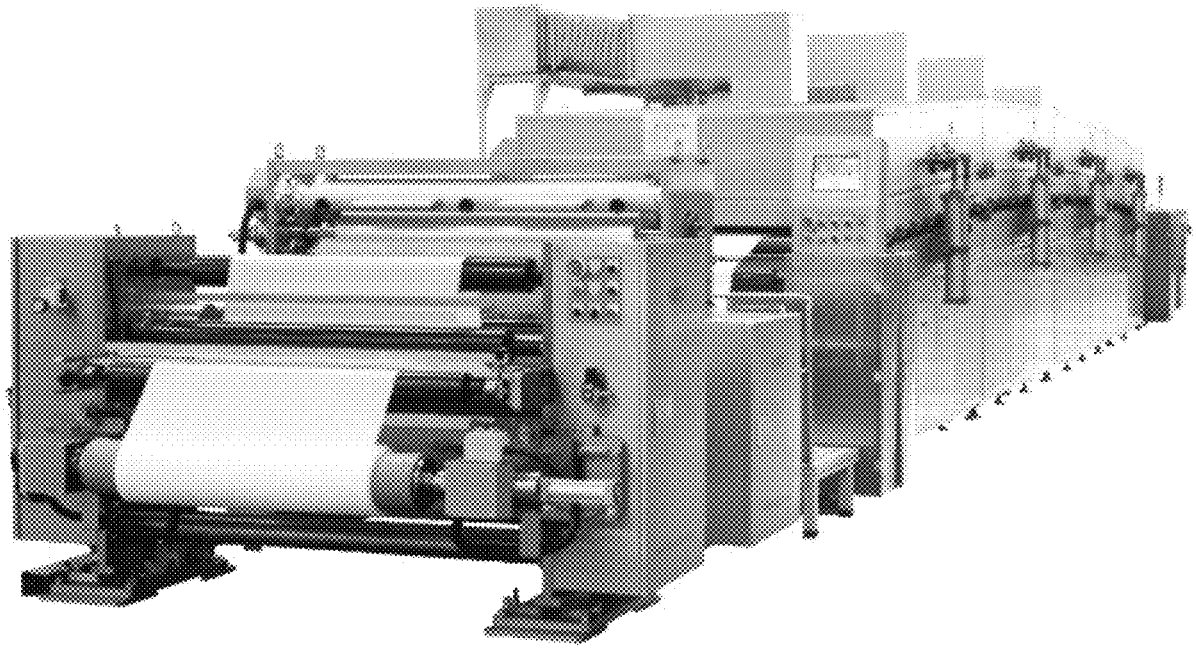
FIG. 1 (PRIOR ART)
FIG. 1 is an isometric view of a conventional coating machine.

Turning to the drawings, FIG. 1 depicts a conventional coating machine is to be used to coat C1S paper with an adhesive. C1S paper is paper that is coated on one side with an adhesive. The conventional coating machine may be that of a ceramic coating machine from Shenzhen Xinjiatuo of China, product model KCDM650-9/12 KCDM1200-12/15. Large size glitter chips are deposited onto the C1S paper and subjected to pressure and heat. Any excess glitter chips are vacuumed away.

Figure 2:
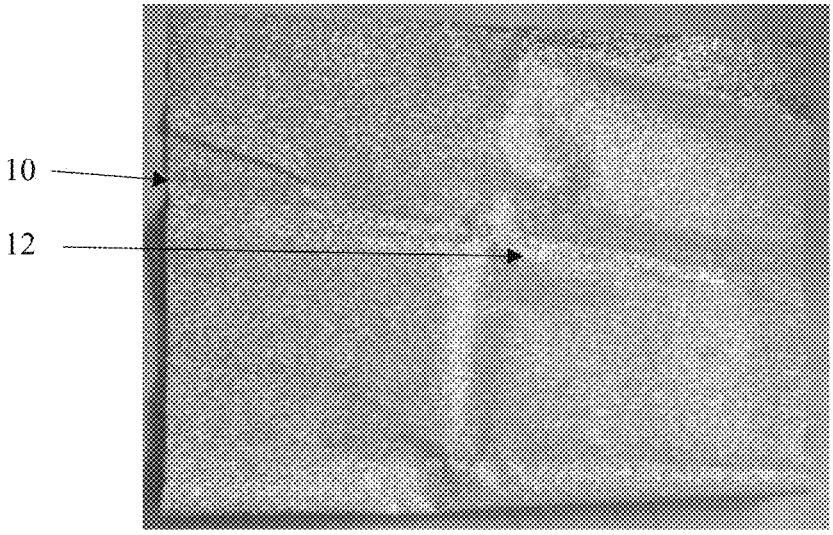
FIG. 2 is a top view of a decorative lamination sheet in accordance with the invention.

FIG. 2 shows a decorative lamination 10, which is a sheet of the C1S paper whose coated side is entirely covered by the glitter chips 12 that have been pressed into the adhesive under heat and pressure from a hot press (such as a heated roller) of the conventional coating machine of FIG. 1. The glitter chips 12 are sparkly from light shining onto them. Preferably, the glitter chips are each at least 0.04 inches in size.

Figure 3:
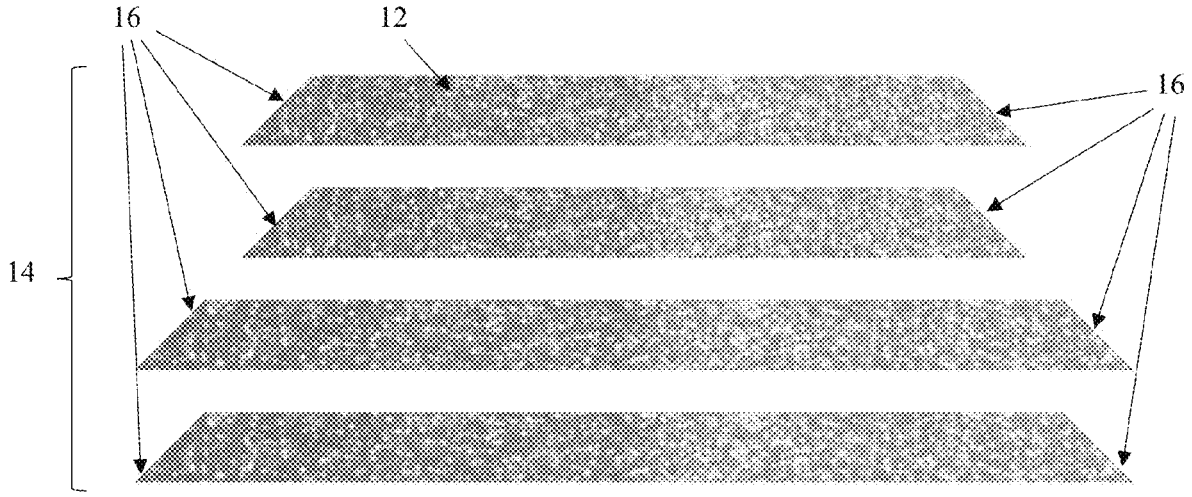
FIG. 3 is a top view of four strips cut from the decorative lamination sheet of FIG. 2.

FIG. 3 shows four strips 14 that are cut from the decorative lamination of FIG. 2. Each of the strips 14 preferably have opposite ends that are cut to form triangular patterns with diagonals 16 as shown. Each of the strips 14 have the glitter chips 12 that entirely cover the upper surface of the strips 14.

Figure 4:
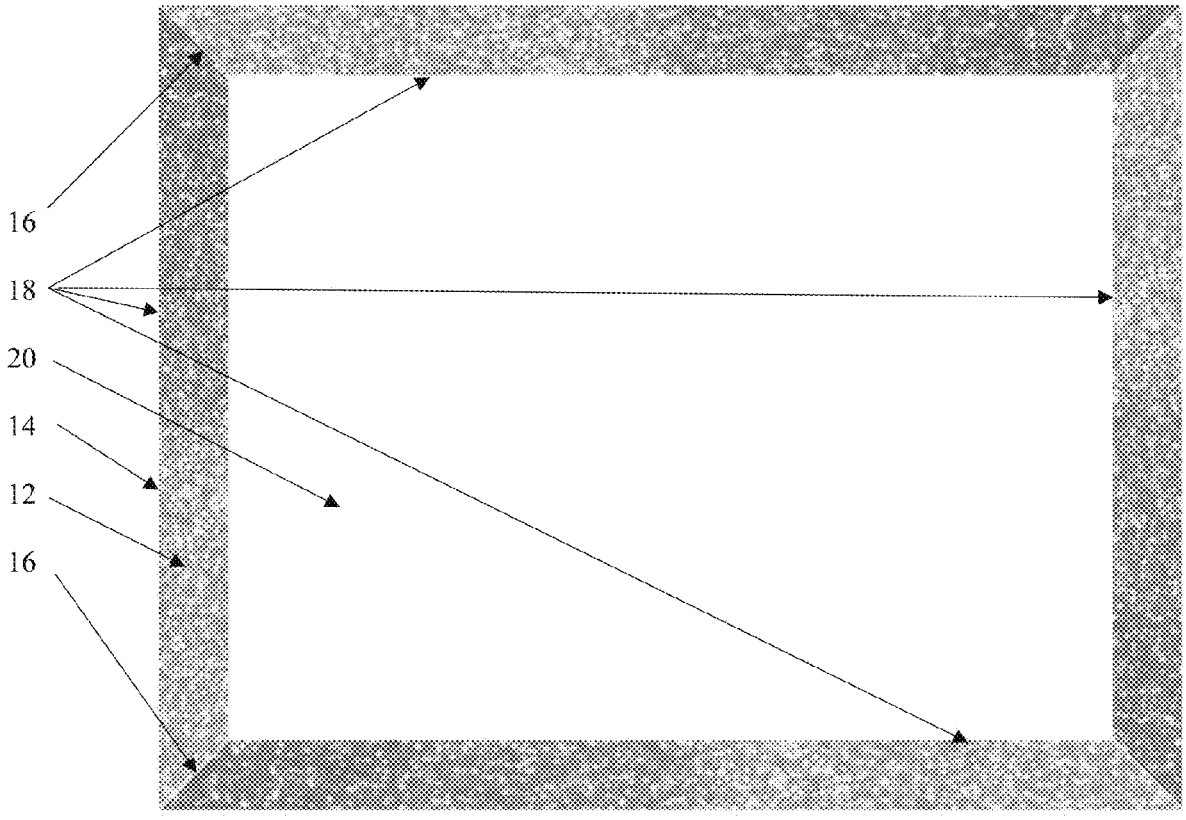
FIG. 4 is a top view of a glitter framed poster board with the four strips of FIG. 3 arranged into a frame and laminated onto peripheral regions of the poster board.

FIG. 4 shows a glitter framed poster board in accordance with the invention whose strips 14 are arranged to form a frame 18 and are adhered to peripheral regions of a conventional poster board. As a consequence, the frame bounds the central region 20 of the poster board. The diagonals 16 from a respective pair of neighboring triangular patterns are in each of the corners of the frame 18 and placed adjacent each other as shown. Although portions of the peripheral region of the poster board can be seen between the adjacent diagonals in FIG. 4, it is preferable for the diagonals to abut each other and thus completely cover the peripheral portions of the poster board that is underneath.

Figure 5:
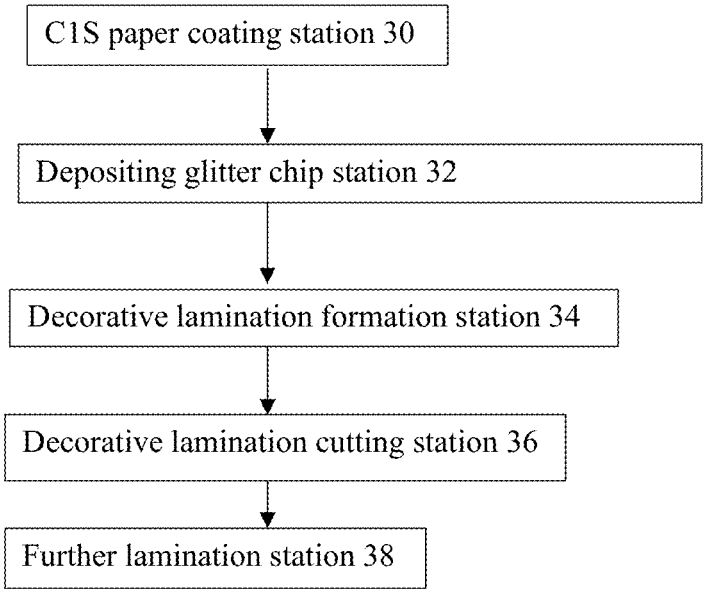
FIG. 5 is a schematic flow diagram of assembly stations arranged in succession for producing the glitter framed poster board of FIG. 4.

FIG. 5 shows the stations arranged in succession that may be used to assemble the glitter framed poster board of the present invention. The first station a C1S paper coating station 30 where the C1S paper is coated with an adhesive.

The second station is a depositing glitter chip station 32 for depositing glitter chips onto the coated side of the C1S paper.

The third station is a decorative lamination formation station 34 where a decorative lamination is formed after heat and pressure are applied by a hot press or heated roller to press the glitter chips into the adhesive on the coated side of the C1S paper. The adhesive responds to the pressure and heat to strengthen its bond between the glitter chips and the C1S paper. The applied heat and pressure that is acceptable for achieving such desired results is at a temperature of at least 400 degrees Fahrenheit under a pressure of at least 8500 pounds for at least three seconds. One can expect the adhesive to take on a uniform thickness over the C1S paper as a result. Any excess glitter chips that were deposited by were not adhered are then vacuumed away with any conventional vacuum source.

The fourth station is a decorative lamination cutting station 36 where the decorative lamination is cut into strips whose ends have triangular patterns. Preferably, there is no plastic covering the glitter chips so they can be touched directly. The adhered glitter chips have an uneven upper surface texture (e.g., non-smooth) across the length of the strips, but not sharp.

The fifth station is a further lamination station 38 where the strips are arranged to form a rectangular frame shape and adhered to peripheral regions of a conventional poster board with glue. Unlike the first-fourth stations that are carried out with machine operation, the further lamination that is performed at the fifth station may be manually performed. That is, the posterboard is glued on the edges by hand, and then the decorative laminated strips are applied by hand onto the glue on the posterboard. One might also expect that the thickness of the glue is thicker than that of the adhesive in the decorative lamination because only the adhesive in the decorative lamination is subjected to heat and pressure from a hot stamping press or heated roller.

There is no reason for there to be any glitter chip shedding at the further lamination station 38 where the further lamination takes place, because the glitter chips have already been adhered onto the C1S paper that has been cut into strips. If there is any shedding subsequently because of how the glitter framed poster board is handled, the overall amount of such shedding is relatively small and cannot be considered to create a mess. Indeed, the overall amount of shedding of the glitter chips that become present in the central region of the poster board is independent of the size of the glitter in accordance with the invention, unlike the case when silk screening is used to apply the glitter chips to glue on the poster board since in that case there is much more shedding of larger size glitter chips (0.42 inches or larger) than there is shedding of smaller size glitter chips (smaller than 0.42 inches).

In accordance with the invention, there is less of a reason to cover the glitter chips at the further lamination station 38 with a coating of clear gloss spray paint, clear gloss spray lacquer, gloss modge podge, clear nail polish, spray sealant or decoupage medium. The reason is because shedding of the glitter chips that occurs during handling appears to be independent of the size of the glitter chips and amounts to a relatively small quantity.

A comparison test was undertaken by the supplier of the framed poster boards from Oct. 31, 2020 to Nov. 1, 2020 that determined over a 24 hour time period that there was in effect no difference in the amount of shedding that occurred when using the method of application according to the present invention as between the use of relatively small glitter chips and the use of relatively large glitter chips (both small and large size glitter chips had between 0-10 glitter chips shedding). However, for the conventional silk screen application, the results show there is a difference in the amount of shedding of the glitter chips depending on the size of the glitter chips. For smaller glitter chips, the amount of shedding was 50-100 smaller glitter chips shed when using the conventional silk screen application. However, for larger glitter chips, the amount of shedding was at least twice to four times as much as for the smaller glitter chips, i.e., between 100 and 200 larger glitter chips shed when using the conventional silk screen application. Thus, one can conclude that the amount of glitter shedding that occurs using the conventional silk screen application is dependent upon the size of the glitter chips. Not so with the method of application according to the present invention—the amount of glitter chip shedding is independent of the glitter chip size and is considerably much less than with the silk screen application by a factor of at least five.

While there may be some shedding of the glitter chips during handling of the glitter framed poster board subsequently, the amount of shedding is independent of the size of the glitter chips. That is, the amount of shedding is at a commercially acceptable level that would not be considered to be messy in contrast to the shedding of larger size glitter chips (0.042 inches or larger) in a glitter framed poster board applied via silk screening. With silk screening, the larger size glitter chips shed to a much greater extent than the smaller size glitter chips after the glitter chips have been deposited onto glue on the poster board to form a frame.

While the foregoing description and drawings represent the preferred embodiments of the present invention, it will be understood that various changes and modifications may be made without departing from the scope of the present invention.

What is claimed is:

1. A method of forming a glitter framed poster board, comprising:

laminating glitter chips to a coated side of paper to form a decorative lamination, the glitter chips having a sparkly characteristic and being arranged to cover an entirety of the coated side;

cutting the decorative lamination into strips;

arranging the strips into a shape of a rectangular frame; and laminating the rectangular frame onto peripheral regions of a poster board with glue such that the rectangular frame bounds a central region of the poster board and thereby forms the glitter framed poster board, the poster board being made of cardboard selected from the group consisting of paperboard, corrugated fiberboard, cardstock and any combination thereof, wherein an overall amount of shedding of the glitter chips present in the central region of the poster board is independent of a size of the glitter chips, wherein the laminating of the glitter chips to the coated side of paper with the adhesive includes depositing the glitter chips onto the coated side of the paper and applying heat and pressure to press the deposited glitter chips into the adhesive on the coated side of the paper to thereby strengthen bonding characteristics of the adhesive because of the applied heat and pressure, wherein the heat applied is at a temperature of at least 400 degrees Fahrenheit for at least three seconds.

2. The method of claim 1, further comprising:

configuring respective ends of the strips into triangular shapes that have diagonals;

arranging the strips relative to each other to define the rectangular frame so that neighboring ones of the strips each have the respective ends located at the corners of the rectangular frame; and arranging one diagonal of each pair of neighboring ones of the triangular shapes adjacent each other at the corners of the frame.

3. The method of claim 2, wherein each of the glitter chips being at least 0.042 inches in size.

4. The method of claim 1, wherein the glitter chips each have a size that is at least 0.042 inches.

5. The method of claim 1, wherein the overall amount of shedding of the glitter chips within 24 hours from a time of the laminating the rectangular frame is at least five times less than arises during a 24 hour period from a further time that further glitter chips are deposited onto glue on a poster board to form a same size rectangular frame in accordance with a silk screen application that deposits the further glitter chips onto the glue.

* * * * *